US005515563A

United States Patent [19]

Chao

[11] Patent Number: 5,515,563

[45] Date of Patent: May 14, 1996

[54] BODY PILLOW HAVING INTERCHANGEABLE COVERS

[76] Inventor: Dwight W. Chao, 17220 Newhope St., Ste. 104–105, Fountain Valley, Calif. 92708

[21] Appl. No.: 368,017

[22] Filed: Jan. 3, 1995

[51] Int. Cl.[6] ..... A47G 9/00; A63H 3/02

[52] U.S. Cl. ..... 5/632; D6/599; 446/369; 5/907; 5/923; 5/490; 5/470

[58] Field of Search ..... D6/599, 601; 446/369, 446/391; 5/630, 632, 640, 470, 490, 907, 923

[56] References Cited

U.S. PATENT DOCUMENTS

| | | | |
|---|---|---|---|
| D. 258,406 | 3/1981 | Elbaum et al. | D6/599 |
| D. 337,683 | 7/1993 | Bowyer | D6/599 |
| 4,309,784 | 1/1982 | Cohen | 5/923 X |
| 4,624,021 | 11/1986 | Hofstetter | 5/632 |
| 4,754,510 | 7/1988 | King | D6/601 |
| 4,763,369 | 8/1988 | Spector | D6/601 X |
| 4,794,657 | 1/1989 | Avery | 5/632 |
| 4,959,879 | 10/1990 | Marxhausen | 5/907 X |
| 5,027,457 | 7/1991 | Sweet | D6/599 |
| 5,148,564 | 9/1992 | Reder | 5/490 X |
| 5,403,224 | 4/1995 | Gintling | 446/391 X |

*Primary Examiner*—Michael F. Trettel
*Attorney, Agent, or Firm*—Francis X. LoJacono

[57] ABSTRACT

The invention comprises a body pillow having an elongated body portion that includes a head portion, the body portion being covered by a pillow case and the head portion being covered by a head cover, wherein the pillow case and head cover are removably mounted over their respective portions, and wherein the pillow case can be printed on one side thereof with one of various caricatures including male or female torsos, and the respective head covers can be provided with male or female caricatures corresponding to said torsos.

19 Claims, 2 Drawing Sheets

BODY PILLOW HAVING INTERCHANGEABLE COVERS

BACKGROUND OF THE INVENTION

1. Field of the Invention

The invention relates generally to a body pillow and more particularly to a body pillow having an interchangeable pillow cover or case on which is printed one of various cartoon characters or figures such as a human torso.

2. Description of the Prior Art

Body pillows are well known in the art and are commonly used to provide comfort and support. Such body pillows are defined by elongated full-length pillows measuring between four to five feet in length and between ten to fifteen inches in diameter. This type of pillow is used as a simple means to support one's body along the back, stomach, knees, shoulders or head as well as an overall body support for pregnant women. The pillow is generally covered with a simple elongated pillow case to match the size of the body pillow.

As examples of pillows that can be found in the art one may refer to several United States patents as follows:

There is disclosed in U.S. Pat. No. Des. 258,406 a combination pillow and pillow case issued to B. M Elbaum showing a pillow case having a head configuration and outwardly extended arms.

In U.S. Pat. No. Des. 317,235 issued to L. Rochon, there is disclosed a pillow having a design configuration with a figure printed thereon.

In U.S. Pat. No. Des. 318,889 issued to E. Van Staagen, et al, there is disclosed a three-dimensional mannequin pillow having a body member, a head, arms, legs and other additional body parts forming various related design configurations.

In U.S. Pat. No. Des. 337,683 issued to E. S. Bowyer, there is disclosed an adult bed pillow having a body member, and head, arm and leg members that form a three-dimensional mannequin.

In U.S. Pat. No. 4,573,927 issued to P. T. Newman, there is disclosed a doll-like figure having a means to allow faces to be changed according to the feelings to be expressed.

In U.S. Pat. No. 5,027,457 issued to D. Sweet, there is disclosed a pillow that is provided with cartoon character and includes arms and legs attached thereto, the arms being semicircular and of sufficient length to enable them to extend either around the neck or torso of a human body.

SUMMARY OF THE INVENTION

It is therefore one of the objects of the present invention to provide an elongated pillow having an approximate length and width which allows it to extend the general length of a human torso so as to support the user's body in a comfortable manner.

It is another object of the present invention to provide a pillow that is adapted to be readily covered by a pillow case on which are printed various ornamental designs, caricatures or human figures in various positions and dress.

Still another object of the present invention is to provide a pillow of this character wherein the printed human figures can be shown in street clothes, pajamas, sportswear, etc.

Yet another object of the invention is to provide an elongated pillow that is formed with a head member on which a head cover or hood is removably mounted, and wherein the cover is printed with a head design which corresponds to the print on the pillow case. That is, if the pillow case has a print of a male figure then the head cover would be provided with a print of the head of a male. Accordingly, the print of the male head can vary so as to be interchangeable with other head designs.

Accordingly, the disclosure herein illustrates two pillow cases, one having a male body figure printed thereon and a female body figure printed on the second embodiment, wherein it can be readily understood that many variations of the male and female faces can be provided so as to be interchangeable with each body print.

It is further an object of the present invention to provide a head cover that is formed with a clear window-like cover that defines a pocket in which pictures, such as interchangeable photographs, can be inserted therein.

The characteristics and advantages of the present invention are further sufficiently referred to in connection with the accompanying drawings, which represent two embodiments. After considering these examples, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts.

DESCRIPTION OF THE PREFERRED EMBODIMENTS

Figure 1:
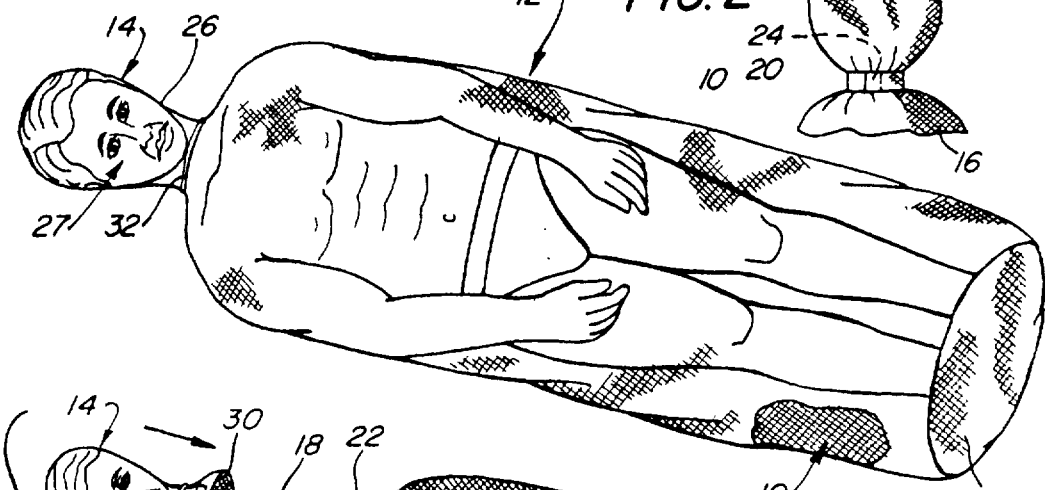
FIG. 1 is a pictorial view of a body pillow in a reclining position having a head cover on which a male face is printed and a pillow case having a corresponding male form printed thereon.

Referring more particularly to FIG. 1, there is shown a fully covered body pillow, generally indicated at 10, arranged in a substantially inclined position and the body pillow which is enclosed in a removable pillow case 12 that includes a separate removable head cover 14. Body pillow 10 comprises an elongated body portion 16 having an extended head portion 18 that is preferably integrally formed throughout its length.

The body pillow 10 is defined by a suitable cotton or acrylic blend poplin fabric that is sewn in a suitable manner to define the body portion 11 and the head portion 13, as illustrated in FIG. 1. The body pillow may be formed so as to have a length of between two to six feet which would include body and head portions 16 and 18, respectively. The body portion 16, however, should be between sixteen to twenty inches in width. The shaped pillow case is filled to the desired thickness of about seven to ten inches with a suitable filling, such as feathers, or other material, either natural or a suitable polyester foam. Body pillow 10 can also be constructed as an inflatable plastic body.

Pillow case 12 and head cover or hood 14 may be formed from a suitable fabric that is smooth and soft to the touch but of a type that allows the surface to be printed by any one of the many known methods now in use, such as silk screening.

Figure 2:
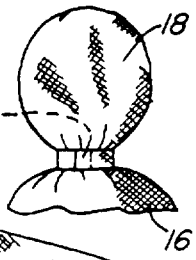
FIG. 2 is an elevational view of the head member of the body pillow being defined by a neck collar.
Figure 3:
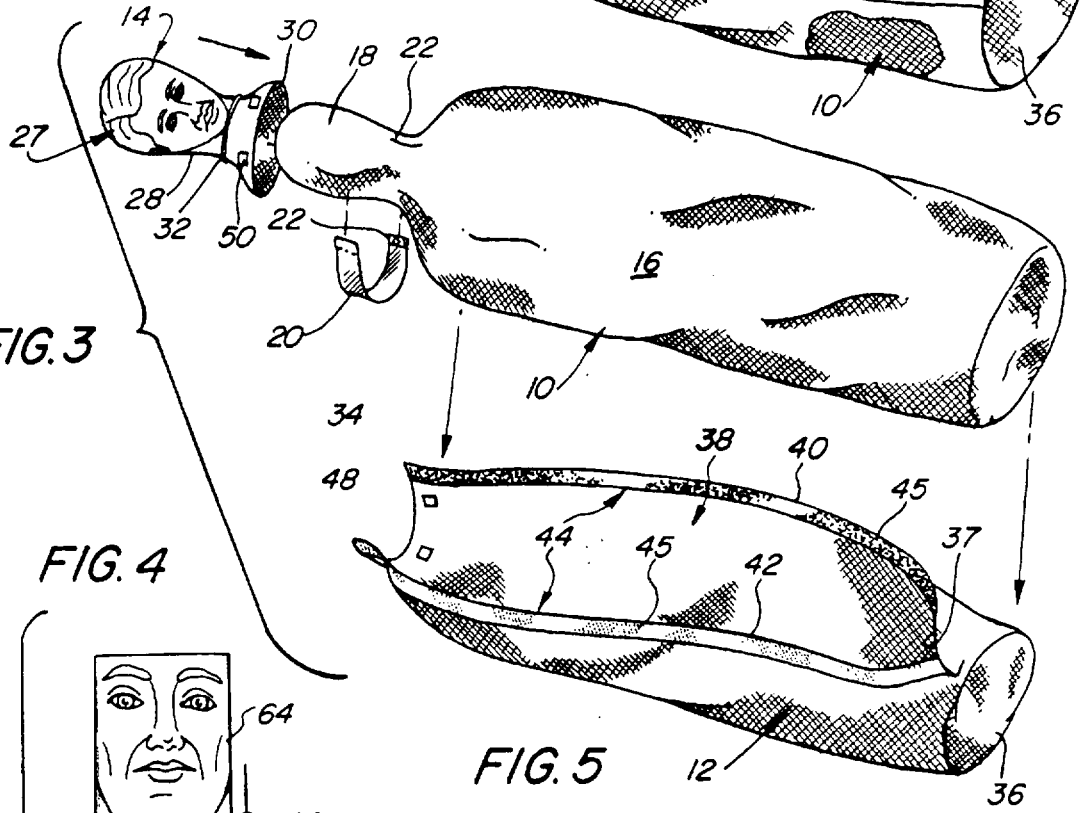
FIG. 3 is a pictorial exploded view according to the body pillow arrangement as seen in FIG. 1, which includes the head cover, the pillow case, and the neck collar removed.

As is illustrated in FIGS. 2 and 3, there is shown a neck restricting means that is defined by a removable collar 20 that is formed long enough to encircle the area between the head portion 14 and body portion 12 so as to better define a neck portion 22 therebetween. A fastening means such as a VELCRO® type hook and loop material, as indicated at 24, is provided adjacent the opposite free ends of collar 20. However, it should be readily understood that other fasteners, such as snaps or hook-and-eye fasteners can be employed. In FIG. 3 collar 20 is shown separated from the pillow, and in FIG. 2 the collar is secured around neck portion 22.

The head cover or hood 14 is formed so as to be positioned over the head portion 18 in a suitable manner, the head cover 14 being defined by an enlarged portion 26 on which is printed or otherwise suitably indicated a face 27 having the features of a male. That is, there are hair, eyes, nose and mouth, wherein the hair and eyes can be provided with different colors to satisfy the selective taste of the user thereof. For example, head cover 14 can be printed with black, brown, red or blond hair and the eyes can also be provided with suitable colors, such as blue, green, brown, etc. Head cover 14 is also provided with a neck area 28 positioned between the head cover and an extended shroud portion 30 so that neck area 28 covers neck portion 22. The overall head cover or hood 14 includes an elastic band 32 that defines a means to hold head cover 14 in its proper position.

After head cover 14 is positioned over the head and neck portions of the body pillow 10, the shroud 30 will cover the upper portion of the pillow body 16. The positioning of the head cover can be accomplished either before or after pillow case 12 is mounted over body portion 16.

FIG. 3 shows the rear of pillow case 12 having a slit 37 that provides an elongated opening 38 defined by oppositely disposed elongated free edges 40 and 42, respectively so as to receive body pillow 10 therein. Both edges 40 and 42 extend from the upper open end 34 downward to a point adjacent the closed bottom end 36 and are each provided with fastening means, indicated generally at 44. The fastening means are illustrated as hook-and-loop fastening strips, indicated at 45 and 46, respectively, which are shown affixed to the opposite free edges so as to allow the body pillow 10 to be easily inserted and then enclosed in the pillow case 12.

However, it is contemplated that other fasteners such as eye hooks and snaps can be used.

Figure 4:
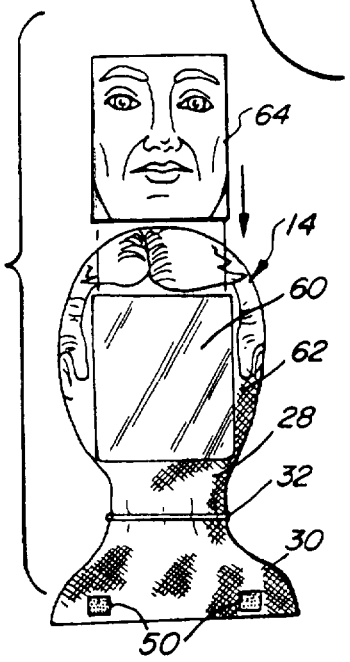
FIG. 4 is an exploded front view of a head cover having a pocket defined by a window cover mounted over the face portion of the cover, whereby a picture is adapted to be positioned therein.
Figure 5:
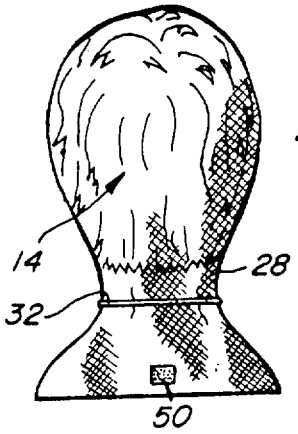
FIG. 5 is a rear elevational of the head cover.
Figure 6:
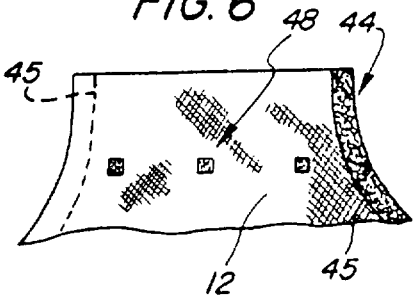
FIG. 6 is an upper open end portion of the pillow case showing fastening means mounted thereon.

As illustrated in FIGS. 4, 5 and 6, additional fastening means 48 are arranged about the inner upper opening 34 of pillow case 12 so as to be aligned with corresponding fasteners 50 that are arranged on shroud 30 of head cover 14.

Figure 7:
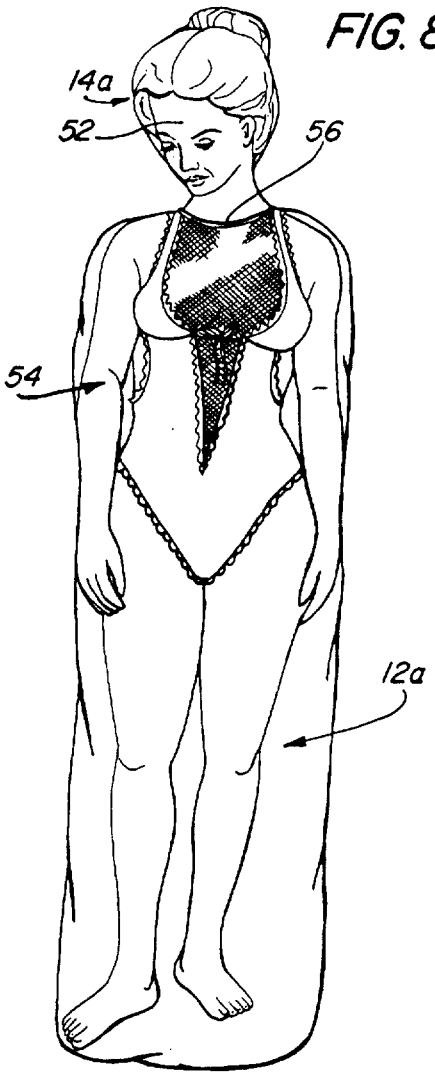
FIG. 7 is a pictorial view of a body pillow of the present invention showing the head cover with a face of a female and a pillow case with a corresponding female body printed thereon.

When these corresponding fasteners 48 and 50 are respectively attached to each other the head cover and pillow case completely encase the body pillow, as seen in FIGS. 1 and 7.

Figure 8:
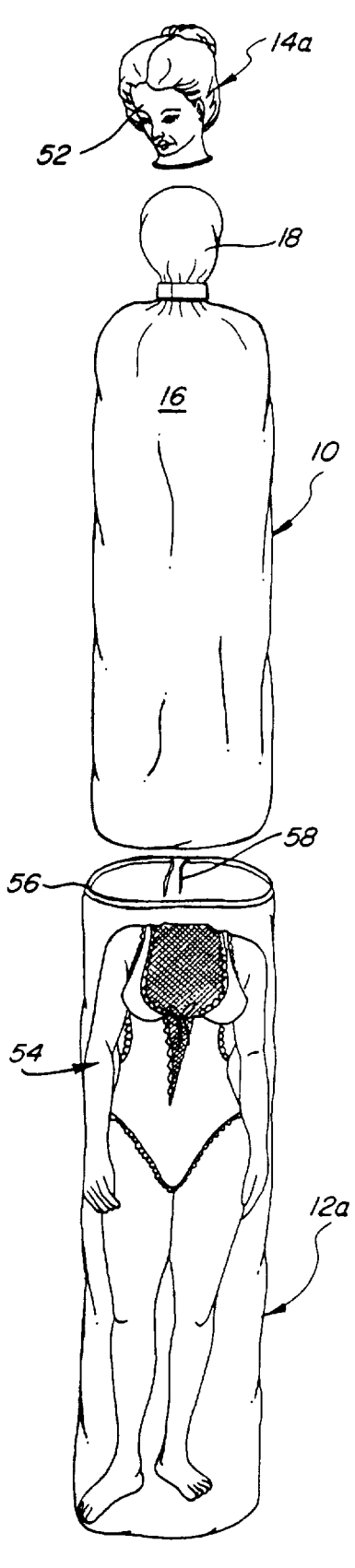
FIG. 8 is an exploded view thereof.

FIGS. 7 and 8 illustrate a second embodiment of the present invention which is very similar to that as described above. In this embodiment the head cover **14*a* shows a female face 52 that corresponds to a female torso 54 printed on pillow case 12*a*. The open end 56 of pillow case 12*a* employs a drawstring 58 which provide an alternative means for securing the pillow case to body pillow 10 at the point where the pillow case overlaps the shroud of hood 14*a*, as indicated in FIG. 7**.

Referring now to FIG. 4, there is shown an alternative head cover or hood 14 which comprises a clear plastic shield 60 that is secured to the surface of the front or face side 62 of head cover 14. Shield 60 is arranged so as to have one open side so as to receive a selective picture or photograph 64. This allows one to insert a particular or personal picture of a love one.

The head cover is shown having a printed portion in which hair and ears are indicated and wherein the picture provides only the face of an individual. However, it is also contemplated that a photograph of one's full face and head can be used so that it will cover the entire front portion of the head cover, thereby eliminating the need for the head cover to have any printed material thereon. For example, a wife could position her husband's picture behind the clear plastic sheet that defines shield 60. The blank face pocket allows one to slide his or her favorite picture into the head cover.

The foregoing should only be considered as illustrative of the principles of the invention. Further, since numerous modifications and changes may readily occur to those skilled in the art, it is not desired to limit the invention to the exact construction and operation as shown and described, and accordingly, all suitable modifications and equivalents may be resorted to, falling within the scope of the claimed invention.

What I claim is:

1. A body pillow having an interchangeable pillow cover comprising:

a body pillow formed with an elongated body portion and including an integrally extended head portion;

a removable pillow case having a shape corresponding substantially to that of said elongated body portion of said body pillow;

means for removably attaching said pillow case to said body portion when said body pillow is inserted therein;

a removable head cover separate from that of said pillow case and having a shape corresponding substantially to that of said head portion; and a neck restricting means removably mounted to encircle the area between said head portion and said body portion, whereby a neck portion is defined therebetween.

2. A body pillow as recited in claim 1 including means for removably fastening said pillow case to said head cover.

3. A body pillow as recited in claim 2, wherein said neck restricting means is defined by a collar having fastening means adjacent the opposite free ends of said collar.

4. A body pillow as recited in claim 3, wherein said head cover is formed with an extended shroud positioned to cover the upper area of said body portion of said body pillow, whereby said extended shroud is positioned to be covered by said pillow case.

5. A body pillow as recited in claim 4, wherein said head cover includes a neck area positioned between said head cover and said extended shroud, and wherein said neck area is formed with an elastic band to hold said head cover and said shroud in proper position over said head portion.

6. A body pillow as recited in claim 4, wherein said means for removably attaching said pillow case to said body portion comprises a drawstring mounted about the open end of said pillow case.

7. A body pillow as recited in claim 4, wherein said means for removably attaching said pillow case to said body portion comprises a slit defining an elongated opening having oppositely disposed elongated free edges that extend substantially the full length of said pillow case, and wherein said free edges include corresponding fastening members mounted thereon.

8. A body pillow as recited in claim 6, wherein said fastening members are defined by hook-and-loop fastening strips.

9. A body pillow as recited in claim 4, wherein said pillow case is decorated with a substantial caricature of a torso, and wherein said head cover is decorated with a head corresponding to said torso.

10. A body pillow as recited in claim 8, wherein said caricature of said torso is indicated as comprising a male or female body printed on said pillow case, and said head indicated as comprising corresponding male or female features printed on said head cover.

11. A body pillow as recited in claim 9, wherein said head cover is formed having a receptacle mounted over the front portion thereof so as to define a pocket comprising a clear plastic cover sheet arranged to receive interchangeable photographs of a selected male or female face so as to be viewed therethrough.

12. A body pillow as recited in claim 4, wherein said body pillow includes said body portion and said head portion is formed having a length of between two to six feet, and wherein said body portion is formed having a width of between sixteen to twenty inches.

13. A body pillow as recited in claim 11, wherein said body pillow is filled with a resilient material selected from the group consisting of feathers, polymeric foam, and natural or synthetic fibers.

14. In combination, a body pillow having a removable pillow case and head cover comprising:

a body pillow formed having an elongated body portion and an integrally extended head portion;

a pillow case having a shape corresponding substantially to that of said elongated body portion of said body pillow;

means for removably securing said pillow case to said body portion of said body pillow when said body pillow is positioned within said pillow case;

a removable head cover separate from that of said pillow case and having a shape corresponding substantially to that of said head portion;

a neck restricting means removably mounted to encircle the area between said head portion and said body portion, whereby a neck portion is defined therebetween.

15. The combination as recited in claim 13, including means for removably fastening said pillow case to said head cover.

16. The combination as recited in claim 14, wherein said neck restricting means comprises a collar having fastening means mounted adjacent the oppositely disposed free ends of said collar.

17. The combination as recited in claim 15, wherein said pillow case is printed on one side thereof with a caricature of a male or female torso and wherein said head cover is provided with a corresponding male or female caricature of said torso.

18. The combination as recited in claim 15, wherein said pillow case is printed on one side thereof with a caricature of a male or female torso, and wherein said head cover is provided with a male or female caricature of said torso that can be matched or mismatched as desired.

19. The combination as recited in claim 15, wherein said pillow case is printed on one side thereof with a caricature of an animal body, and wherein said head cover is provided with a matching head of the animal body.

* * * * *